US008232856B2

(12) United States Patent
Zeng et al.

(10) Patent No.: US 8,232,856 B2
(45) Date of Patent: Jul. 31, 2012

(54) CONNECTOR AND POWER TRANSFORMER STRUCTURE COMPRISING THE SAME

(75) Inventors: Jianhong Zeng, Shanghai (CN); Bin Wang, Shanghai (CN); Hongyang Wu, Shanghai (CN); Jianping Ying, Shanghai (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 255 days.

(21) Appl. No.: 12/029,081

(22) Filed: Feb. 11, 2008

(65) Prior Publication Data

US 2009/0085702 A1 Apr. 2, 2009

(30) Foreign Application Priority Data

Sep. 29, 2007 (TW) ..... 96136595 A

(51) Int. Cl.
*H01F 27/04* (2006.01)
*H01F 27/29* (2006.01)
*H01F 5/00* (2006.01)

(52) U.S. Cl. ..... 336/107; 336/192; 336/200

(58) Field of Classification Search ..... 336/107, 336/192, 200, 223, 138, 140, 232
See application file for complete search history.

(56) References Cited

U.S. PATENT DOCUMENTS 2,474,395 A * 6/1949 Early et al. ..... 336/107
4,205,291 A * 5/1980 Flentge ..... 336/92
4,873,757 A * 10/1989 Williams ..... 29/602.1
4,939,623 A * 7/1990 Equi et al. ..... 361/752
5,345,670 A * 9/1994 Pitzele et al. ..... 29/606
5,781,093 A * 7/1998 Grandmont et al. ..... 336/232
6,335,671 B1 * 1/2002 Roessler et al. ..... 336/65
6,876,555 B2 * 4/2005 Matsumoto et al. ..... 361/782
7,567,164 B2 * 7/2009 Chin ..... 336/198
2002/0070835 A1 * 6/2002 Dadafshar ..... 336/200
2005/0212640 A1 * 9/2005 Chiang et al. ..... 336/200
2006/0279394 A1 * 12/2006 Estrov ..... 336/200

FOREIGN PATENT DOCUMENTS

CN 1230843 12/2005

OTHER PUBLICATIONS

Chinese Office Action from corresponding Chinese Application No. 200710181117.4 dated Mar. 17, 2010.

* cited by examiner

*Primary Examiner* — Mohamad Musleh
*Assistant Examiner* — Mangtin Lian
(74) *Attorney, Agent, or Firm* — Grossman, Tucker, Perreault & Pfleger, PLLC

(57) ABSTRACT

A connector and a power transformer structure comprising the same are provided. The power transformer structure comprises a connector and an integrated transformer. The connector comprises a plurality of connection units, and the integrated transformer comprises a plurality of transformation units. The transformation units are sequentially stacked and electronically connected to the corresponding connection units in contact connection to reduce the current conduction consumption and contact resistance.

5 Claims, 8 Drawing Sheets

CONNECTOR AND POWER TRANSFORMER STRUCTURE COMPRISING THE SAME

This application claims the benefit of priority based on Taiwan Patent Application No. 096136595 filed on Sep. 29, 2007 of which the contents are incorporated herein by reference in its entirety

CROSS-REFERENCES TO RELATED APPLICATIONS

Not applicable.

BACKGROUND OF THE INVENTION

1. Field of the Invention

The present invention relates to a connector and a power transformer structure comprising the same. More particularly, the present invention relates to a connector and a power transformer structure comprising the same that may decrease current conduction loss and contact resistance.

2. Descriptions of the Related Art

With rapid development of semiconductor technologies, a variety of chips are requiring a lower voltage level but a higher supply current. Meanwhile, power supply are becoming increasingly higher efficiency and high power density. Under such conditions, in addition to the optimized design of circuit topologies, component and circuit parameters, design of other aspects such as the printed circuit board (PCB) layout, wiring, mechanism design and thermal design also plays a more and more important role in optimizing a power supply circuit.

Referring to FIG. 1, that illustrates a schematic diagram of a conventional transformer 1. The transformer 1 comprises a plurality of transformation units 10 and copper posts 11*a* and 11*b*. The copper posts 11*a* and 11*b* are respectively connected with the current output ends 100 and 101 of each transformation unit 10 by welding, so that the output current from each transformation unit 10 is transmitted out via the copper posts 11*a* and 11*b*.

Referring to FIG. 2, that illustrates a schematic partial diagram of a power supply device comprising a transformer 1 disposed on a power supply motherboard 2. The power supply motherboard 2 comprises copper foils 2*a* and 2*b* respectively connected with the copper posts 11*a* and 11*b* by welding, so that the output current from the transformer 1 is transmitted out via the copper posts 11*a* and 11*b*. Further Referring to FIG. 3 corresponding to FIG. 2, FIG. 3 is a schematic diagram of connector between a power supply motherboard and a load. The power supply motherboard 2 has a plurality of connection units 3, which are connected with the copper foils 2*a* and 2*b* respectively by welding. Additionally, connector motherboard 4 has a plurality of connection terminals 40, which are welded to one end of the conducting boards 4*a* and 4*b* respectively, while a load 5 is connected to the other end of the conducting boards 4*a* and 4*b* of the connector motherboard 4 via connecting lines 5*a* and 5*b*. In this way, the output current from the transformer 1 is transmitted to the load 5 sequentially through the connection units 3, connection terminals 40, the conducting boards 4*a*, 4*b* of the connector motherboard 4, and the connecting lines 5*a*, 5*b*.

However, to cater for the continuous increase in power density of power supplies, volume of the connecting structure between the transformer 1 and the load 5 has to be reduced accordingly, which requires a corresponding reduction of the number of parallel output connections of the transformer. Unfortunately, in the connecting structure described above, the conducting connections downstream of the connection between the transformer 1 and the power supply motherboard 2 are distributed in a plane, which leads to underutilization of the overall space of the transformer 1 in the height dimension. Furthermore, a considerable number of welding points exist in the connecting structure described above, such as the welding joints between the copper post 11*a*, 11*b* and the current output terminals 100, 101 of each transformation unit 10, and also the welding joints between the copper posts 11*a*, 11*b* and the copper foils 2*a*, 2*b*. Such welding points may cause increasing contact resistance and energy loss, with a consequence that the load 5 can not effectively receive the power energy supplied by the conventional transformer 1.

In summary, how to effectively utilize the overall space of a transformer in the height dimension and decrease the contact resistance and energy loss between the transformer and the load is still an objective for the industry to endeavor.

SUMMARY OF THE INVENTION

One objective of the present invention is to provide a power transformer structure comprising a connector and an integrated transformer. The connector comprises a plurality of connection units, and the integrated transformer comprises a plurality of transformation units. These transformation units are sequentially stacked and electronically connected to the corresponding connection units in contact connection for outputting power to a load via the connector.

Another objective of the present invention is to provide a connector for use in a power transformer structure comprising an integrated transformer. The integrated transformer comprises a plurality of transformation units which is sequentially stacked. The connector comprises a plurality of connection units and at least one conductor. The connection units are electronically connected to the corresponding transformation units in contact connection so that the integrated transformer outputs power to a load via the connector. The at least one conductor is electronically connected to the connection units.

According to the present invention, the integrated transformer and the connector are electrically connected in contact connection instead of in welding connection as used in the conventional, thereby to decrease contact resistance therebetween. Moreover, the connector and the transformation units are vertically connected in parallel, in order to make full use of the overall space of the transformer structure in the height dimension and effectively decrease the conduction loss. As a result, disadvantages of the conventional can be overcome effectively.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

The present invention relates to a power transformer structure that may effectively utilize the overall space thereof in the height dimension and decrease conduction loss. The following embodiments will be described to explain the present invention. However, these embodiments are not intended to limit that the present invention can only be embodied in any specific context, applications or with particular methods described in these embodiments. Therefore, description of the embodiments is only intended to illustrate the present invention, rather than to limit the present invention. It should be noted that, in the following embodiments and attached drawings, elements not directly relating to the present invention are omitted from the diagrams, and the dimensional relationships among various elements are deliberately exaggerated for ease of understanding.

Figure 1:
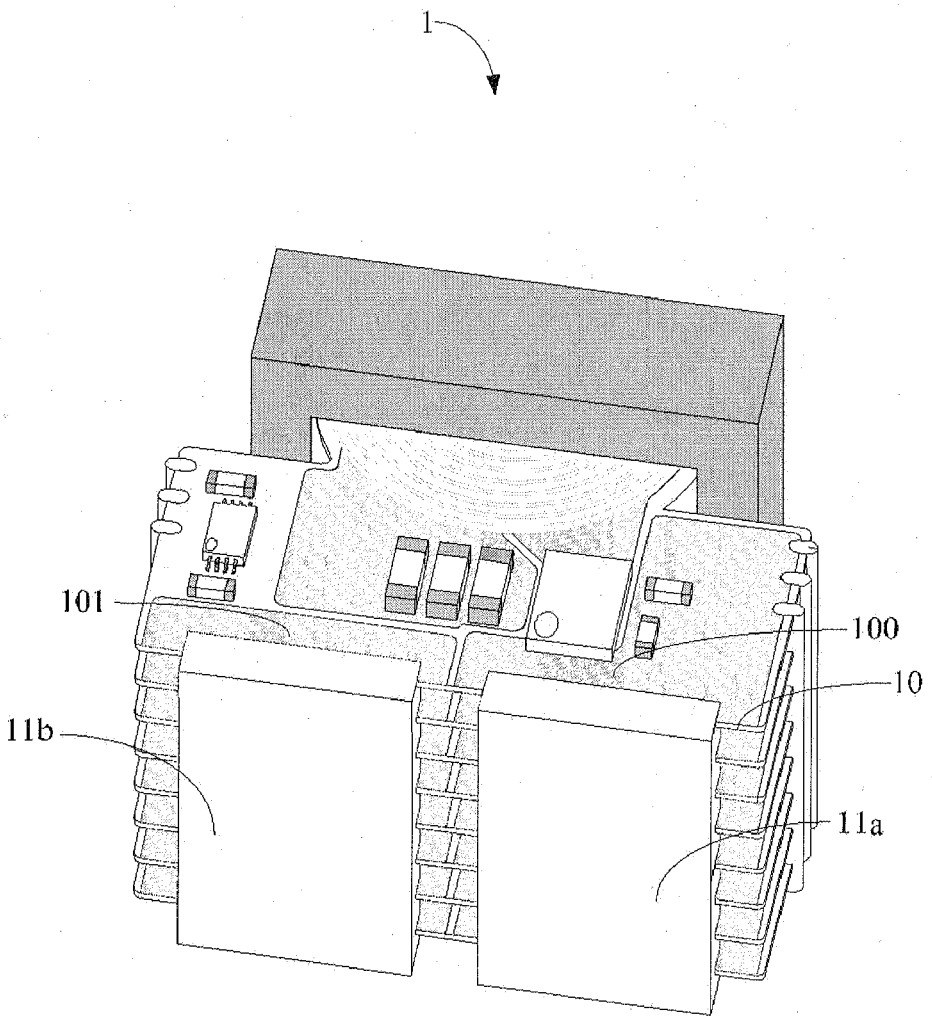
FIG. 1 (Prior Art)
FIG. 1 is a schematic diagram of a conventional transformer.
Figure 2:
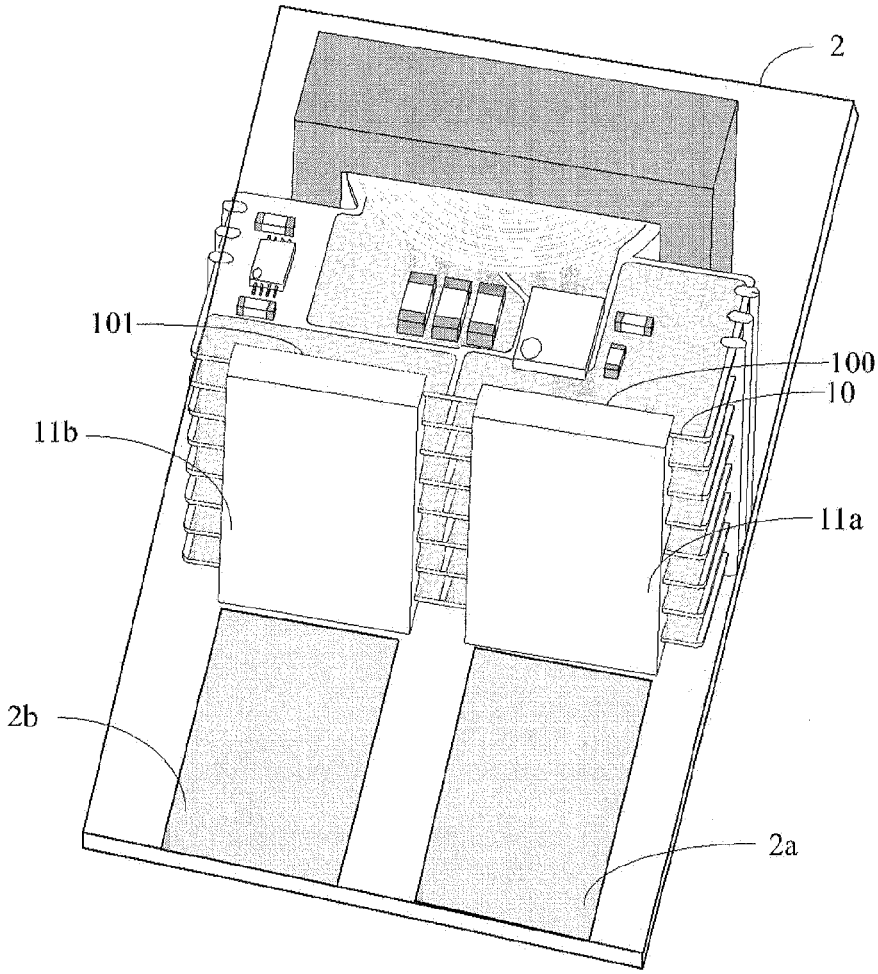
FIG. 2 (Prior Art)
FIG. 2 is a schematic diagram of a conventional transformer disposed on a power supply motherboard.
Figure 3:
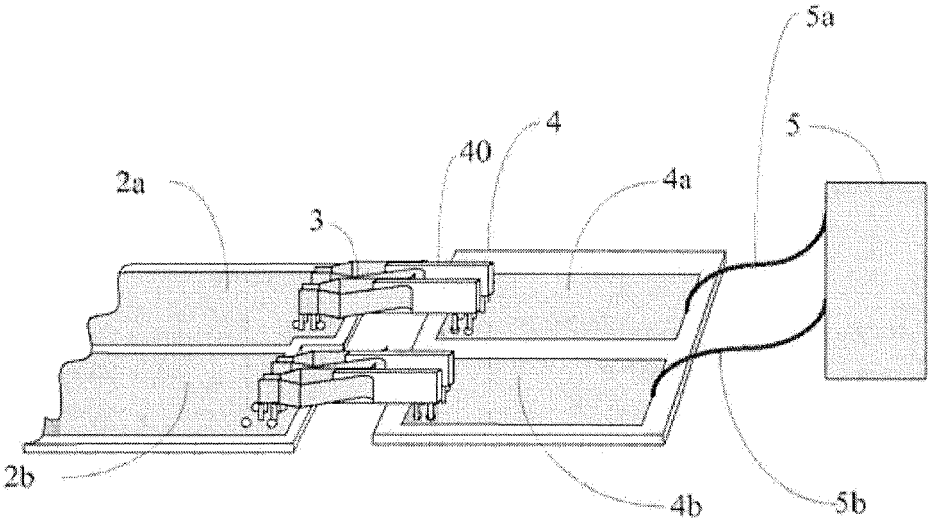
FIG. 3 (Prior Art)
FIG. 3 is a schematic diagram of connector between the power supply board and a load corresponding to FIG. 2.
Figure 4:
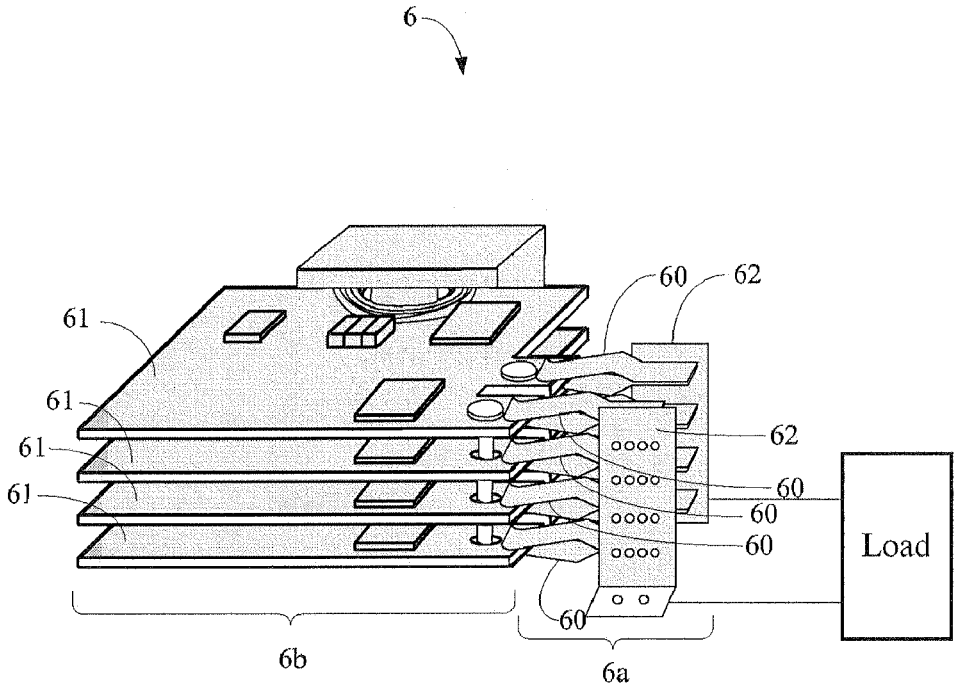
FIG. 4 is a schematic diagram of a power transformer structure and corresponding connector in accordance with a first embodiment of the present invention.

A power transformer structure 6 of a first embodiment of the present invention is illustrated in FIG. 4. The power transformer structure 6 may be applied in a high frequency power converter, which is well-known by people skilled in the art and redundant description is omitted hereinafter. The power transformer structure 6 comprises a connector 6*a* and an integrated transformer 6*b* electrically connected with each other in contact connection. More particularly, the connector 6*a* comprises a plurality of connection units 60 and a conductor 62, while the integrated transformer 6*b* comprises a plurality of transformation units 61. In the embodiment, the conductor 62 is a conductor bus bar. The transformation units 61 are sequentially stacked with each other and electrically connected to corresponding connection units 60 in contact connection. The conductor 62 is configured to electrically connect to the connection units 60, so that current from the power transformer structure 6 can be transferred through the connection units 60 and the conductor 62 to a load electrically connected with the conductor 62. The transformation units 61 are electrically connected in parallel together.

Figure 5A:
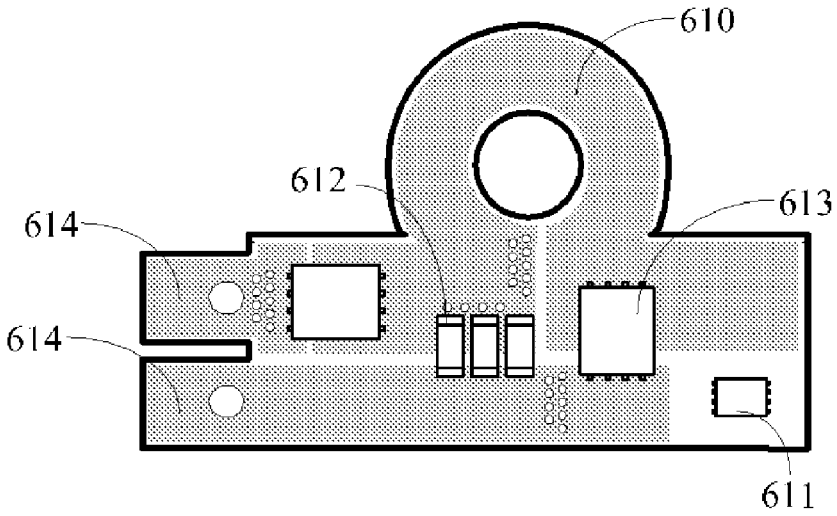
FIG. 5A is a top diagram of a secondary PCB circuit in the first embodiment of the present invention.
Figure 5B:
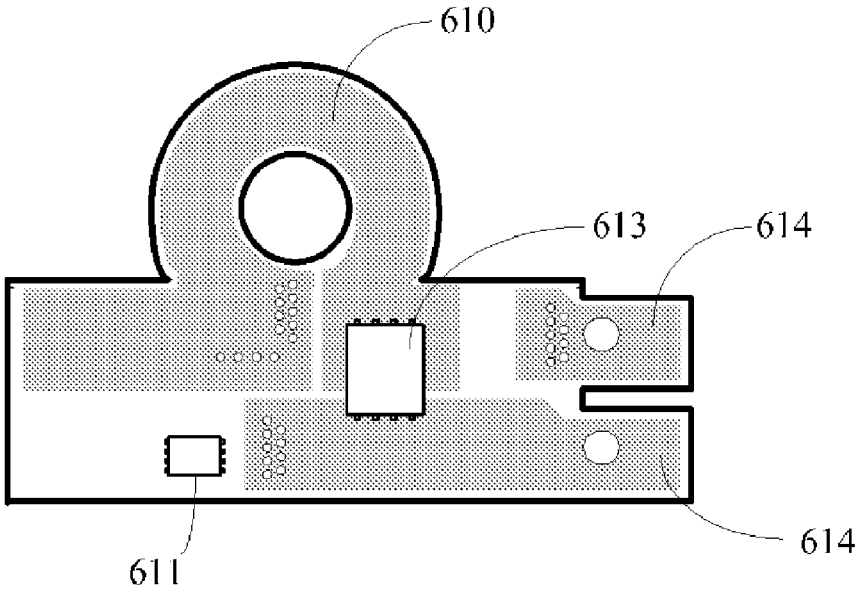
FIG. 5B is a bottom diagram of the secondary PCB circuit in the first embodiment of the present invention.

In this embodiment, each of the transformation units 61 is a flat transformation unit comprising a primary winding (not shown) and a secondary printed circuit board (PCB) circuit (described in detail hereafter), where the primary winding is implemented with the conventional technologies and will not be described herein. Please referring to FIG. 5A and FIG. 5B, a vertical view diagram and an upward view diagram of the secondary PCB circuit are illustrated respectively therein. The secondary PCB circuit comprises a secondary winding 610, a rectifier 611, a capacitor 612, a driving circuit 613 and a goldfinger structure 614, where the rectifier 611 and the capacitor 612 are conventional electronic elements and will not be described herein. The driving circuit 613 functions as a switch for the power transformer structure 6, and the goldfinger structure 614 is configured to electrically connect the transformation units 61 with the connection units 60 in contact connection. Specifically, the goldfinger structure 614 of any of the transformation units 61 is electrically connected with corresponding connection units 60 in contact connection, so that any of the transformation units 61 may supply a current to the connection units 60 and further to the load therefrom via its own goldfinger structure 614.

Figure 6:
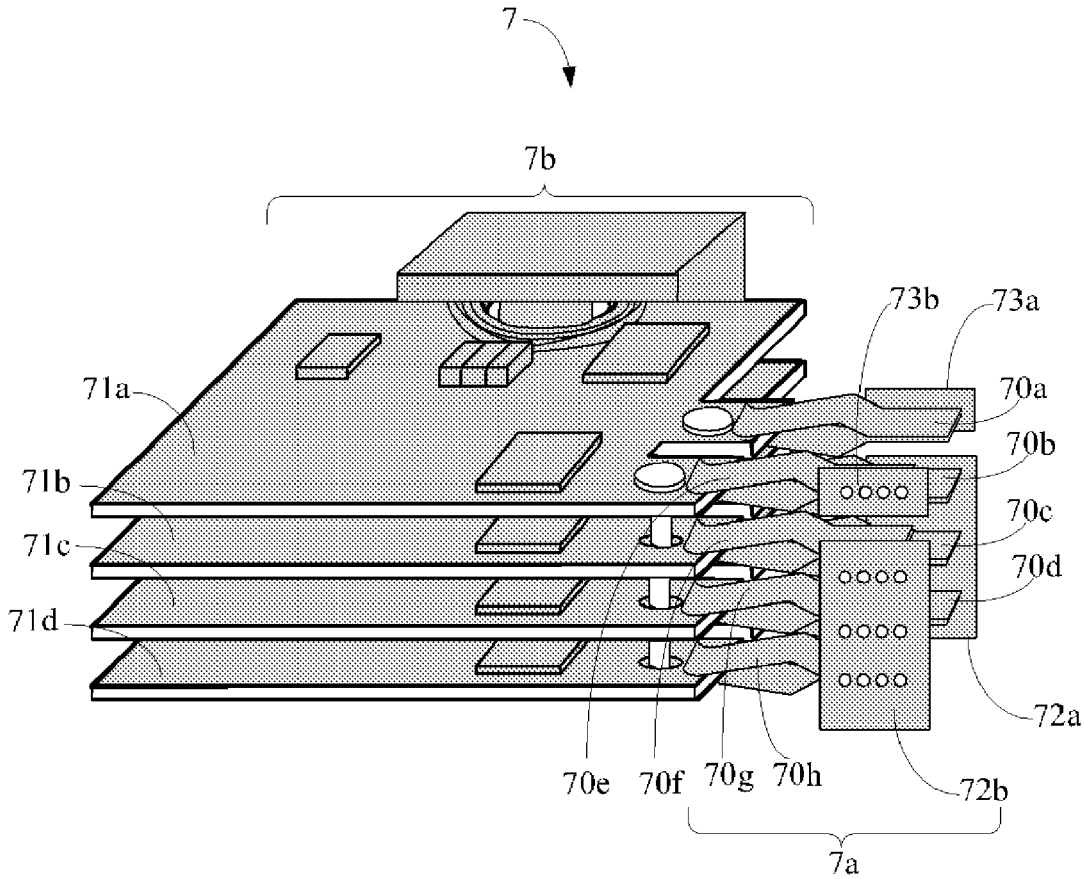
FIG. 6 is a schematic diagram of a power transformer structure and corresponding connector in accordance with a second embodiment of the present invention.

Referring to FIG. 6, where illustrates a power transformer structure 7 of a second embodiment of the present invention. The power transformer structure 7 comprises a connector 7*a* and an integrated transformer 7*b*. The connector 7*a* further comprises a plurality of connection units 70*a*, 70*b*, 70*c*, 70*d*, 70*e*, 70*f*, 70*g*, 70*h* and a plurality of conductors 72*a*, 72*b*, 73*a*, 73*b*. The integrated transformer 7*b* comprises a plurality of transformation units 71*a*, 71*b*, 71*c*, 71*d*, where each of the conductors are electrically connected with at least one of the connection units. In this embodiment, the conductor 73*a* is connected to the connection unit 70*a*, the conductor 73*b* is connected to the connection unit 70*e*, the conductor 72*a* is connected to the connection units 70*b*, 70*c*, 70*d*, and the conductor 72*b* is connected to the connection units 70*f*, 70*g* and 70*h*. The transformation unit 71*a* is electrically connected to the conductors 73*a* and 73*b* via the connection units 70*a* and 70*e* respectively, and similarly, the transformation units 71*b*, 71*c* and 71*d* are electrically connected to the conductors 72*a* and 72*b* respectively. As a result, the transformation units 71*b*, 71*c* and 71*d* connected to the conductors 72*a* and 72*b* are electrically connected with each other in parallel.

With above configurations, welding connections as used in the conventional transformer are replaced by the electrically contacting connections in the power transformer structure of the present invention. That decreases the contact resistance. Moreover, by use of parallel connections, the present invention effectively uses the overall space of the transformer structure in the height dimension and decreases the conduction loss by parallel connection.

Figure 7:
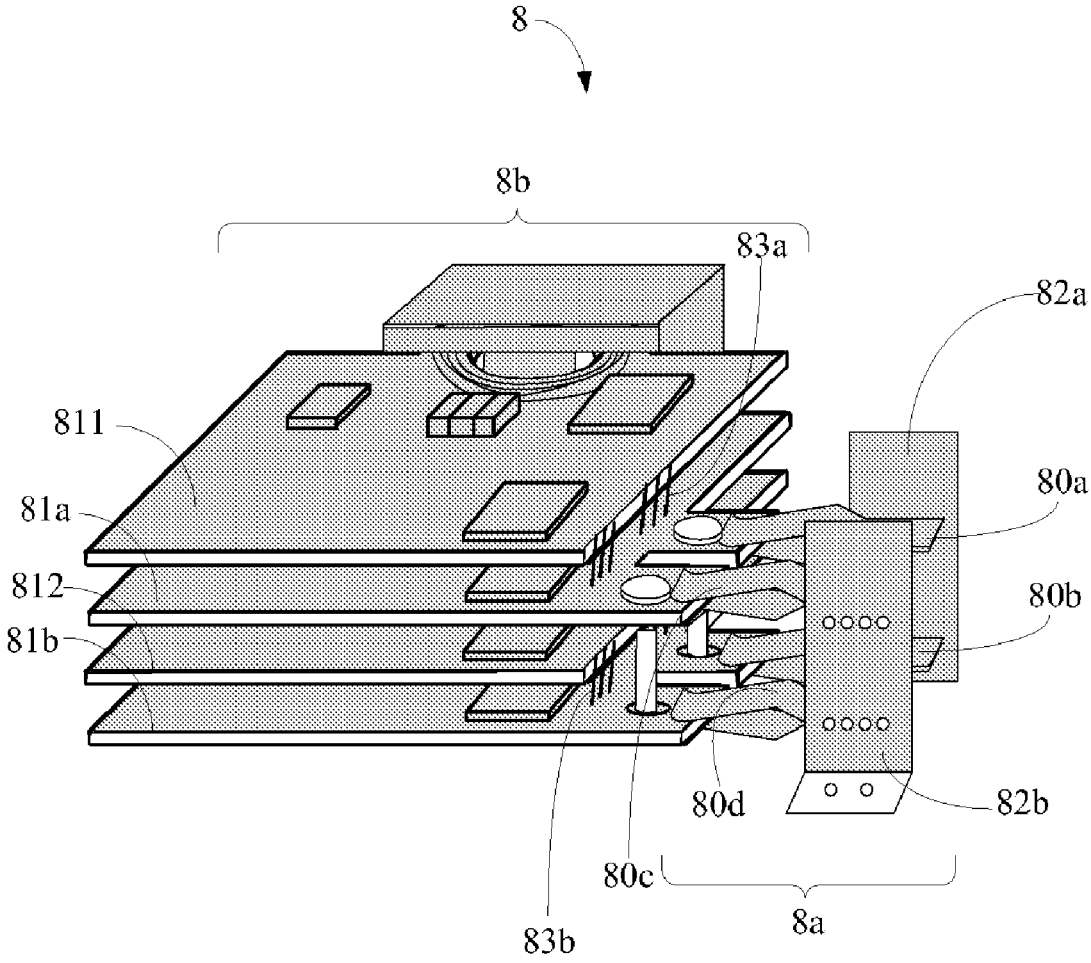
FIG. 7 is a schematic diagram of a power transformer structure and corresponding connector in accordance with a third embodiment of the present invention.

A power transformer structure 8 of a third embodiment of the present invention is illustrated in FIG. 7. The power transformer structure 8 comprises a connector 8*a* and an integrated transformer 8*b*. The connector 8*a* comprises a plurality of connection units 80*a*, 80*b*, 80*c*, 80*d*, conductors 82*a*, 82*b*, and internal conductors 83*a*, 83*b*. The integrated transformer 8*b* comprises a plurality of transformation units 811, 81*a*, 812, 81*b*. The functions of the connection units 80*a*, 80*b*, 80*c*, 80*d*, the transformation units 811, 81*a*, 812, 81*b*, and the conductors 82*a*, 82*b* are the same as the ones described in the previous embodiment, and will not be described herein.

The most significant difference from the previous embodiment lies in that this embodiment comprises internal conductors 83*a*, 83*b*. Taking the internal conductor 83*a* as an example, it is configured to have the transformation units 811 and 81*a* connected with each other in parallel, so that the transformation units 811 and 81*a* connected in parallel may be electrically connected to the connection units 80*a* and 80*c* in contact connection. Specifically, in this embodiment, since the two transformation units 811 and 81*a* are connected together by the internal conductor 83*a*, more current may be output to the connection units 80*a*, 80*c* as compared to the single transformation unit. In this embodiment, the internal conductors 83*a*, 83*b* are made of copper. However, the number of transformation units connected in parallel by the internal conductors 83*a*, 83*b* and the material of the internal conductors 83*a*, 83*b* are just for purpose of illustration, rather than to limit the scope of the present invention.

Figure 8:
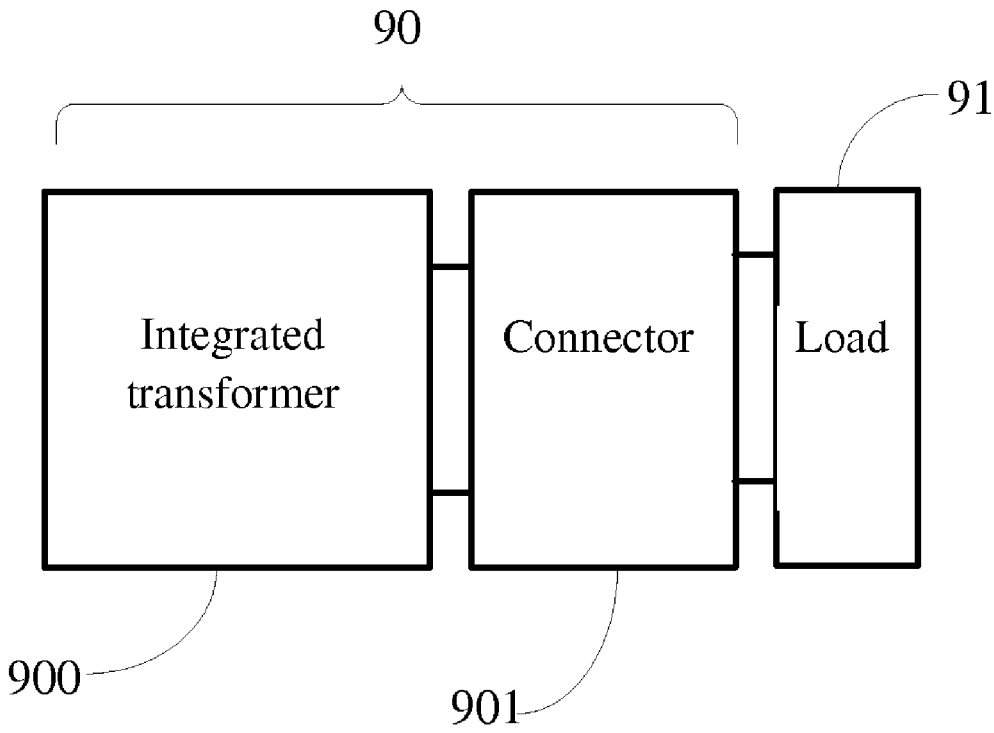
FIG. 8 is a schematic diagram of connection between a power transformer structure and a load.

Referring to FIG. 8, FIG. 8 is a schematic diagram of connection between a power transformer structure 90 and a load 91. The power transformer structure 90 comprises an integrated transformer 900 and a connector 901, wherein the integrated transformer 900 is connected to the load 91 via the connector 901 to supply power to the load 91. It should be noted that, the connection structure illustrated in FIG. 8 may also be applied in other embodiments described above.

In practical industrial applications, the connector is typically an indispensable separate element. The integrated transformer is installed in a fixed housing and has the output end connected with the connector via an opening of the housing. The connection units of the connector and conductors are installed in an insulation (plastic) housing of the connector. The connector is connected with the output terminals of the integrated transformer via the connection units. The connection units and conductors of the connector eliminate the copper posts (11*a*, 11*b*) and the copper foils (2*a*, 2*b*) existing in the conventional transformer structures, when keep functions (busbar) of the original structure with a lower energy loss.

As described above, in the present invention, the transformation units and the connection units are electrically connected in contact connection to decrease the contact resistance. Moreover, the connection units and the transformation units are vertically connected in parallel to effectively use the overall space of the transformer structure in the height dimension and to effectively decrease the conduction loss. As a result, disadvantages of the conventional techniques can be overcome effectively.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A power transformer structure, comprising:

a connector comprising a first, a second, and a third connection unit; and an integrated transformer comprising a first, a second, and a third transformation unit, the transformation units being sequentially stacked, said first connection unit having a first end connected only to said first transformation unit in contact connection without welding connection, said second connection unit having a first end connected only to said second transformation unit in contact connection without welding connection, said third connection unit having a first end connected only to said third transformation unit in contact connection without welding connection, wherein said integrated transformer is configured to output power to a load via the connector.

2. The power transformer structure of claim 1, wherein the connector further comprises a conductor being electronically connected to the connection units.

3. The power transformer structure of claim 1, wherein the transformation units are electronically connected in parallel connection.

4. The power transformer structure of claim 1, wherein any of the transformation units comprises a goldfinger structure being configured to make the transformation units electronically connected to the connection units in contact connection via the goldfinger structure.

5. A connector for use in a power transformer structure comprising an integrated transformer, the integrated transformer comprising a first, a second, and a third transformation unit sequentially stacked, the connector comprising:

a first, a second, and a third connection unit, said first connection unit having a first end connected only to said first transformation unit in contact connection without welding connection, said second connection unit having a first end connected only to said second transformation unit in contact connection without welding connection, said third connection unit having a first end connected only to said third transformation unit in contact connection without welding connection, wherein said integrated transformer is configured to output power to a load via the connector; and at least one conductor being electronically connected to the connection units.

* * * * *